United States Patent [19]

Imai et al.

[11] Patent Number: 5,063,198

[45] Date of Patent: Nov. 5, 1991

[54] DYE TRANSFER TYPE THERMAL PRINTING SHEETS

[75] Inventors: Akihiro Imai, Ikoma; Tetsuji Kawakami; Hiromu Matsuda, both of Katano; Keiichi Yubakami, Suita; Nobuyoshi Taguchi, Ikoma, all of Japan

[73] Assignee: Matsushita Electric Industrial Co., Ltd., Osaka, Japan

[21] Appl. No.: 504,606

[22] Filed: Apr. 5, 1990

[30] Foreign Application Priority Data

Apr. 14, 1989 [JP] Japan ..... 1-095762
Dec. 7, 1989 [JP] Japan ..... 1-318054

[51] Int. Cl.[5] ..... B41M 5/035; B41M 5/26

[52] U.S. Cl. ..... 503/227; 8/471; 428/195; 428/447; 428/913; 428/914

[58] Field of Search ..... 8/471; 428/195, 913, 428/914; 503/227

[56] References Cited

U.S. PATENT DOCUMENTS 4,724,228 2/1988 Hann ..... 503/227

*Primary Examiner*—Bruce H. Hess

*Attorney, Agent, or Firm*—Stevens, Davis, Miller & Mosher

[57] ABSTRACT

The dye transfer type thermal printing sheet of the present invention comprises (a) a substrate, and (b) a lamina comprising a dye and either a cured product of a moisture curing type resin or a reaction-cured product of a moisture curing type resin and a reactive silicone oil, on at least one side of the substrate.

According to the present invention, a surface release property and surface lubricity can easily be imparted to the color material layer or to the surface layer. Further, since no crosslinking agent is required to cure the resin, curing at low temperature becomes possible. The dye transfer type thermal printing sheet of the present invention can provide a printing sheet useful for high speed recording and/or relative speed recording.

15 Claims, 1 Drawing Sheet

DYE TRANSFER TYPE THERMAL PRINTING SHEETS

Figure 1:
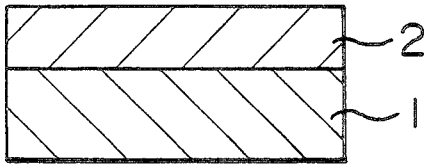

The present invention relates to a dye transfer type thermal printing sheet used for sublimation type thermal transfer recording which utilizes such recording means as thermal heads, optical heads (wherein used laser etc.) and heads consisting of an array of electrodes. In particular, it relates to a dye transfer type thermal printing sheet useful in high-speed recording systems and/or relative speed recording systems. In these recording systems, the recording is conducted with a relative speed difference provided between a printing sheet and an image receiving sheet.

In general, a color material layer of a dye transfer type thermal printing sheet contains at least a dye and a binder. In so far, various thermoplastic resins have been proposed as a binder, but thermosetting resins have also been proposed. For example, JP-A-58-215,397 proposes to use a crosslinking resin as a binder.

Resins usable as a binder are classified into thermoplastic resins and thermosetting resins and they are large in number. Therefore, resins well suited for intended purposes need to be selected out of them. When the printing sheet is to be used in recording of higher speed than before and/or in relative speed recording, the following points must be considered. (1) Resins which are liable to be softened or deformed by the heat generated in recording are not suited for enabling a high speed and/or relative speed recording. In general, thermosetting resins are better in heat resistance than thermoplastic ones. (2) In order to make a high speed recording possible in the same recording density as in a low speed recording or in order to prevent the melt-sticking of a printing sheet to an image receiving sheet, the binder should be selected from those which have a high dye-dispersing capability, surface release property and surface lubricity to the color material layer. However, resins proposed previously did not have surface release property nor surface lubricity. (3) In general, the degree of crosslinking of a cured resin influences on the dye-dispersing property. There are many thermosetting resins requiring a crosslinking agent. Since the crosslinking agent remains as a constituent in the cured product, the amount of the agent added must be determined in view of the degree of crosslinking of the resins and the quality of the product. (4) Many thermosetting resins generally cure at elevated temperatures or by ultraviolet light. However, these conditions are apt to cause the deterioration of the dye or, conversely, the presence of the dye is apt to cause undercure of the resin (5) Also for multilayer structure printing sheets, in which the color material layer has a multilayer structure, a good surface release property and surface lubricity suitable for high speed recording and/or relative speed recording are required. However, multilayer structure sheets which are satisfactory in these properties have hitherto been not known.

Thus, an object of the present invention is to provide a dye transfer type thermal printing sheet suitable for use in high speed recording and/or relative speed recording. The object is attained by utilizing a resin which is excellent in the function of imparting surface release property and surface lubricity to the color material layer or to the surface layer of the printing sheet having a multilayer structure on the color material layer side, requires no crosslinking agent which remains as a constituent in the cured product, and readily cures at low temperature; or by using a color material layer or surface layer which are excellent in surface lubricity.

According to the present invention, there is provided a dye transfer type thermal printing sheet comprising (a) a substrate, and (b) a lamina comprising a dye and either a cured product of a moisture curable resin or a reaction-cured product of a moisture curable resin and a reactive silicone oil, on at least one side of the substrate.

Figure 2:
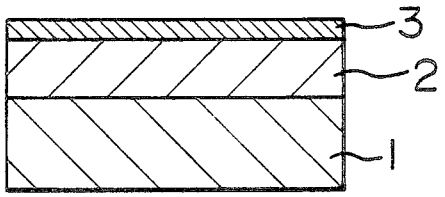
Figure 3:
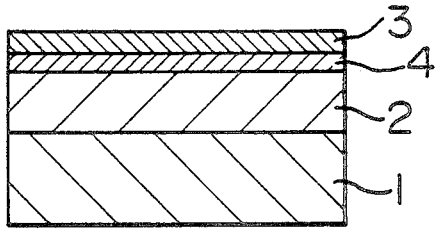

FIGS. 1, 2 and 3 are each a schematic sectional diagram showing one embodiment of the dye transfer type thermal printing sheet according to the present invention, numeral 1 being a substrate, 2 a color material layer, 3 a surface layer and 4 an intermediate layer.

In FIG. 1, a color material layer 2 is provided on a substrate 1. In FIG. 2, on a substrate 1 are laminated a color material layer 2 and a surface layer 3; in FIG. 3, on a substrate 1 are laminated a color material layer 2, an intermediate layer 4 and a surface layer 3, successively.

In the present invention, the term "lamina" refers to a layer or multilayer formed on the same side of the substrate. In the case the term refers to a layer, the layer comprises a dye and either a cured product of a moisture curable resin or a reaction-cured product of a moisture curable resin and a reactive silicone oil. In the case the term refers to multilayer, for example two laminated layers, one of the layers is on at least one side of a substrate and comprises at least one dye and at least one binder, and the other layer thereon, i.e. the surface layer comprises either a cured product of a moisture curable resin or a reaction-cured product of a reactive silicone oil.

In the present invention, the term "color material layer" means a layer comprising a dye. Therefore, this term is usually used as expressing the layer comprises a dye and either a cured product of a moisture curable resin or a reaction-cured product of a moisture curable resin and a reactive silicone oil, but sometimes used as expressing the layer comprising at least one dye and at least one binder.

The substrate 1 is not specifically restricted and may be a film of various polymers conventionally used. Specific examples thereof are films obtainable by stretching, casting etc. of polyester, polyamide, polyimide, polyparabanic acid, etc. Preferred is aramid film. There may also be used various films coated with various coating materials such as electroconductive coating materials, primers (i.e., anchor coating materials) antistatic coating materials; films laminated with various materials; and electroconductive films containing conductive particles such as carbon particles dispersed therein.

The color material layer 2 in FIG. 1 comprises at least one cured product of a moisture curable resin and a dye, or comprises at least one reactioncured product of a moisture curable resin with a reactive silicone oil and a dye.

The surface layer 3 in FIGS. 2 and 3 comprises at least one cured product of a moisture curable resin or at least one reaction-cured product of a moisture curable resin with a reactive silicon oil.

The dye is not specifically restricted so long as it is useful for thermal transfer recording. For example, a disperse dye, basic dye, oil soluble dye, color former etc. may be used.

When the printing sheet has a layer or layers further laminated on the color material layer as shown in FIGS. 2 and 3, the color material layer comprises at least one dye and at least one binder.

The binder is not particularly restricted. A variety of thermoplastic resins and thermosetting resins may be used for the binder. Specific examples of the thermoplastic resin include urethane resin, vinyl resin, amide resin, nylon resin, ether resin, cellulosic resin, ester resin, and phenolic resin. Specific examples of the thermosetting resin include epoxy resin, phenolic resin, ester resin, urethane resin, vinyl resin and acrylic resin.

A variety of polymeric substances may be used for the intermediate layer 4. For example, various resins exemplified as the binder for use in the color material layer of multilayer structure may be used. Water-dispersible resins and water-soluble resins may also be used. The surface layer 3 or the intermediate layer 4 also may contain a dye. The multilayer structure may also be formed of four or more layers The moisture curable resin is a resin having a hydrolyzable silyl and/or silanol group at the molecular terminal or in the side chain. The moisture curable resin cures at room temperature through the mechanism of crosslinking caused by moisture in the air. Therefore, it does not cause deterioration of the dye nor undercure due to the dye. A moisture curable resin containing an ester, urethane, amide, ether, or epoxy structure in the molecule is particularly useful. Such a resin gives a cured product of high dye-maintaining capability so that the storage reliability of the resulting printing sheet is improved. Also useful are moisture curable resins synthesized from or modified with acrylic or methacrylic acid and the derivatives thereof, halogenated hydrocarbons, acrylonitrile, and cellulose and its derivatives, which resins show similar desirable properties.

Specific examples of the hydrolyzable silyl groups are silyl groups wherein such groups as hydride, halogen, alkoxy, acyloxy, amino, amido, aminoxy, alkenyloxy, oxime, thioalkoxy, and phenoxy are bonded to a silicon atom. Specific examples of compounds containing such silyl groups are described, for example, in JP-A-60-231,722. The method for forming hydrolyzable functional groups is shown, for example, in JP-A-54-123,192.

Example of the moisture curable resin having a silyl group at the molecular terminal or in the side chain are described below.

(1) A urethane-vinyl polymer consisting essentially of a copolymer of a urethane prepolymer whose terminal NCO groups have been capped by a vinyl compound having an active hydrogen and by a silane coupling agent having an active hydrogen, and a vinyl monomer (JP-A-59-232,110).

(2) A polyurethane having a vinyl group and a hydrolyzable silyl group having the following formula (JP-A-60-260,222),

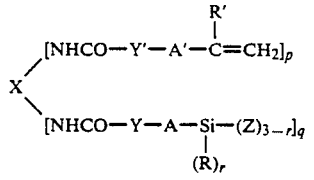

wherein X is the residual group of a urethane prepolymer, $X(NCO)_{p+q}$, having a molecular weight of 200–40,000; p and q each denote an integer of 1 or more satisfying the formula $2 \leqq p+q \leqq 8$; r denotes 0, 1 or 2; Y and Y' each independently denote —O—, —S— or

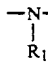

$R_1$ being H or an alkyl or aryl group having 1–12 carbon atoms; R denotes an alkyl or aryl group having 1–12 carbon atoms; Z denotes a halogen, alkoxy, acyloxy, amido, aminoxy, alkenyloxy, amino, oxime or thioalkoxy group; R' denotes H or an alkyl group having 1–12 carbon atoms; A denotes the residual group of a silane coupling agent containing an active hydrogen,

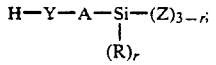

and A' denotes the residual group of a vinyl compound containing an active hydrogen,

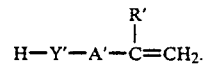

(3) A polyurethane obtained by allowing (A) an NCO-terminal urethane prepolymer of a polymer polyol formed from a polyol and an ethylenically unsaturated monomer to react with (B) a silane coupling agent having an active hydrogen (JP-A-60-133,019).

(4) A modified vinyl resin obtained by allowing an isocyanate-organic silane to react with the hydroxyl group of a hydroxyl group-containing vinyl polymer having the structural units (a) a hydroxyl groupcontaining monomer unit, (b) an acrylic or methacrylic acid derivative unit and/or an aromatic hydrocarbon vinyl monomer unit and optionally (c) other polymerizable monomer unit, the contents of (a), (b) and (c) being 5–80% by weight, 20–95% by weight and 0–20% by weight, respectively (JP-A-61-106,607).

(5) A modified polyurethane obtained by allowing a polymer polyol formed from a polyol and an ethylenically unsaturated monomer to react with an organic polyisocyanate and an isocyanate-organic silane (JP-A-61-200,116).

(6) A moisture curable resin having a hydrolyzable silyl group at the molecular terminal or in the side chain described in, for example, JP-B-46-30,711; and a urethane polymer having the formula,

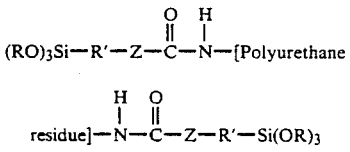

wherein R denotes an alkyl group, R' denotes a divalent hydrocarbon group, and Z denotes —S—or —NR, the latter R being hydrogen or an alkyl group (JP-A-51-73,561).

(7) A moisture curable silicon-terminated polyurethane obtained by allowing a urethane prepolymer having a terminal active hydrogen atom to react with an isocyanate-organic silane having a terminal isocyanate group and at least one hydrolyzable alkoxy group bonded to the silicon atom (JP-A-58-29,818).

(8) A moisture curable resin described in Japanese Patent Publication Kokoku Nos. 45-36,319 and 46-12,154, for example, a polyether type polymer having the formula,

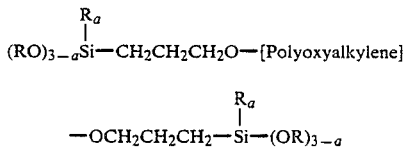

wherein R denotes an alkyl group, and a denotes an integer of 0–2.

(9) A moisture curable resin described in Japanese Patent Publication Kokoku No. 47-26,415, for example, an acryl-silicon resin (UA-01, available from Sanyo Chemical Industries, Ltd.)

(10) A moisture curable resin described in JP-A-62-292,820, for example, an acryl-urethane-silicon resin (UA-53 and UA-40, available from Sanyo Chemical Industries, Ltd.).

(11) A vinyl resin having in the molecule at least one silyl of the formula,

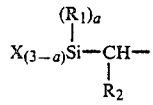

wherein $R_1$ and $R_2$ are each independently hydrogen or a monovalent hydrocarbon group selected from alkyl, aryl and aralkyl groups of 1–10 carbon atoms; X is a group selected from halogen, alkoxy, acyloxy, aminoxy, phenoxy, thioalkoxy and amino groups; and a is an integer of 0–2 (JP-A-54-36,395 and JP-A-54-123,192). Particularly good results are obtained when the vinyl resin contains as a component or as a main component a homopolymer or a copolymer formed of at least one monomer selected from the group consisting of acrylic acid, methacrylic acid and the derivatives thereof (for example, methyl acrylate, methyl methacrylate, butyl acrylate, butyl methacrylate, acrylonitrile etc.), styrene, α-methylstyrene, alkyl vinyl ether, vinyl chloride, vinyl acetate, vinyl propionate and ethylene.

Resins containing a silanol group which may be used include a silicon resin having a silanol group at the terminal or in the side chain, and a hydrolyzed product of a resin having a hydrolyzable silyl group at the terminal or in the side chain.

Particularly useful among the moisture curable resins are:

(1) acryl-silicon resins because they can give a color material layer of high heat resistance and hence can meet the requirement of high speed recording, (2) urethane-silicon resins because they are excellent in dye-dispersing property and hence can meet the requirement of a color material layer of high recording sensitivity, and (3) acryl-urethane-silicon resins because they enable wide selection of their component ratio and hence can give a color material layer capable of meeting the requirement of high recording density and high speed recording.

Of the moisture curable resins, a fluorine-containing moisture curable resin obtained by further introducing fluorine into the molecule is particularly useful because such a resin is highly advantageous in preventing melt-sticking to the image receiving sheet. Even when a polymer which is readily softened by heat is used as the binder in the color material layer or in the surface layer in order to improve the dye-dispersing property, the melt-sticking of these layers to the image receiving sheet can be completely prevented by adding the fluorine-modified moisture curable resin.

Particularly, introducing those having a perfluoroalkyl group into the molecule are highly advantageous in view of the above-mentioned effect. Resins containing one or more perfluoroalkyl groups in the molecule which perfluoroalkyl group has 4–20 carbon atoms may be preferably used. The fluorine-containing moisture curable resin usually has a ratio of the average molecular weight to the sum of the atomic weight of the fluorine atoms contained in the molecule in the range of 5,000:1 to 100:20. Particularly useful is the fluorine-containing moisture curable resin described in JP-A-62-558.

Of the moisture curable resins, also a silicone-containing moisture curable resin obtained by introducing one or more units derived from silicone into the resin molecule is particularly useful because a resin imparts lubricity to the color material layer surface when added to the layer. For example, the unit derived from silicone can be introduced into the resin by the use of various reactive silicone oils, reactive siloxane oligomers, etc. which have been modified with SiH, silanol, alkoxy, carboxyl, epoxy, amino, alcohol, vinyl compounds, allyl compounds etc. In particular, a moisture curable resin which is a silicone-containing acryl-silicon resin containing a hydrolyzable silyl group and having the formula,

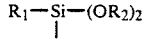

wherein $R_1$ is hydrogen or an alkyl group having 1–4 carbon atoms and $R_2$ is an alkyl group having 1–4 carbon atoms, gives a good result when used for a coating material because the hydrolyzable silyl group has a long pot life.

Also the moisture curable resin containing both fluorine and silicone may be used with good results.

The average molecular weight of the moisture curable resin is usually 200–100,000, preferably 500–50,000.

A color material layer or a surface layer of high surface lubricity can be obtained by forming these layers with adding a reactive silicone oil capable of reacting with a moisture curable resin in order to impart a surface release property and lubricity to the color material layer or the surface layer, or in order to further enhance these properties. The reactive silicone oil may be, for example, various silicone oils modified with SiH, silanol, alkoxy, alcohol, carboxyl, epoxy etc. It is also possible to use a moisture curing resin having various functional groups (such as an epoxy and hydroxyl group) introduced in the molecule, and a reactive silicone oil capable of reacting with these functional groups. Also, various silicone oils, various modified silicone oils, various coupling agents including those based on silane, titanate, aluminum etc., and like additives may be incorporated to the resin to be used.

The curing of the moisture curable resin and the reaction-curing thereof with the reactive silicone oil are preferably effected by using a cure accelerator (i.e., curing catalyst). Cure accelerators which may be used are titanates, amines, organic tin compounds, acidic compounds, etc., for example, alkyltitanates, metal salts of carboxylic acids such as tin octoate, dibutyltin dilaurate, and dibutyltin maleate, amine salts such as dibutylamine-2-hexoate, and other curing catalysts described in JP-A-58-19,361, JP-A-60-51,724 and JP-A-60-13,850. The amount of the cure accelerator to be added is normally 0.001–20% by weight relative to the resin.

When the moisture curable resin or the reactive silicone is used in the form of coating material, a storage stabilizer may be used together as occasion demands. For example, stabilizers described in JP-A-60-51,724 and JP-A-57-147,511 may be used.

Of the moisture curable resins and the reactive silicone oils described above, the followings are commercially available.

Moisture curable acryl-urethane-silicon resin UA-53,

Moisture curable acryl-silicon resin UA-01,

Dimethylsiloxane-containing acryl-silicon resin wherein the crosslinking group is the methyldimethoxysilyl group, F-6A-4

Moisture curable fluorine-containing acryl-silicon resin F-2A

Moisture curable dimethylsiloxane-containing acryl-silicon resin F-6A

Those resins listed above are commercially available from Sanyo Chemical Industries, Ltd.

Polyvinylbutyral resin BX-1 (available from Sekisui Chemical Co., Ltd.),

Silanol-modified silicone oil L-9000 (100) (available from Nippon Unicar Co., Ltd.), Alkoxy-modified silicone oil Y-1587 (available from Nippon Unicar Co., Ltd.), Coronate L (available from Nippon Polyurethane Industry Co., Ltd.)

The color material layer of FIG. 1 or the surface layer of FIGS. 2 and 3 may contain various polymeric substances other than the moisture curable resin. Of various polymeric substances, particularly preferred are polymers which allow easy diffusion of dispersion dyes. There may be used, for example, polyester resin, epoxy resin, urethane resin, acrylic resin, cellulose acetate resin, polyvinylacetal resin, etc. Particularly when saturated polyester resin, urethane resin, polyvinyl acetal resin, styrene resin, vinyl acetate resin etc. are used in combination with the moisture curable resin, the resulting sheet shows a high recording sensitivity. These polymeric substances can be added in an amount of 10 times or more the amount of the moisture curable resin in terms of weight ratio of solid content.

The color material layer, intermediate layer or surface layer may contain various additives including particles, lubricants, surface active agents, antistatic agents, ultraviolet absorbers, antioxidants, etc.

The present invention will be described below with reference to Examples.

EXAMPLE 1

A carbon-containing aramid film (thickness: 15 μm, surface resistance: 0.7 kΩ/□) was used as a substrate. With a wire bar, the film was coated on one side with a coating material consisting of 3 parts by weight of a cyan dye having the formula shown below, 6.4 parts by weight of a moisture curable acrylurethane-silicon resin solution (UA-53, effective ingredient 49% by weight, available from Sanyo Chemical Industries, Ltd.), 0.8 part by weight of a saturated polyester resin (VYLON, RV-220, available from TOYOBO, CO., LTD.), 0.1 part by weight of a reaction accelerator (dibutyltin dilaurate), 0.2 part by weight of a moisture curable fluorine-containing acryl-silicon resin solution (F-2A, effective ingredient 48% by weight, available from Sanyo Chemical Industries, Ltd.), 0.8 part by weight of a moisture curable dimethylsiloxane-containing acryl-silicon resin (F-6A, effective ingredient 52% by weight, available from Sanyo Chemical Industries, Ltd.), 20 parts by weight of toluene and 10 parts by weight of 2-butanone. Then, the coated film was subjected to a curing reaction at 60° C. for 10 hours to obtain a printing sheet including a color material layer having a thickness of about 1 μm.

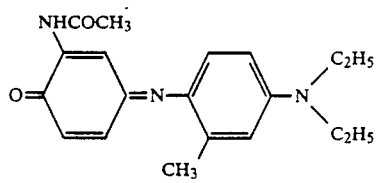

On the other hand, on a white PET substrate having a thickness of about 100 μm was provided a saturated polyester resin layer (i.e., anchor coat layer) having a thickness of 0.1 μm. Then, the anchor-coated substrate was coated further thereon, with a wire bar, a coating material consisting of 20 parts by weight of an acrylurethane-silicon resin solution (UA-40, effective ingredient 50% by weight, available from Sanyo Chemical Industries, Ltd.), 0.3 part by weight of a reaction accelerator (di-n-butyltin dilaurate), 10 parts by weight of toluene and 10 parts by weight of 2-butanone. Then, the resulting sheet was subjected to a curing reaction in an oven at 100° C. for 30 minutes. Thus, an image receiving sheet including a dye-receiving layer having a thickness of about 3 μm was prepared.

The printing sheet and the image receiving sheet obtained above were set between an electrically conductive stylus head and a platen. Then, recording was conducted under an applied pressure of about 3 kg under the following conditions.

Recording speed: 4.2 ms/line

Recording voltage: 32 V

The record image was subjected to the determination of recording density with a Macbeth densitometer (RD918, available from Macbeth: A division of Kollmorgen Corporation). The recording density was 1.9. No melt-sticking occurred between the printing sheet and the image receiving sheet.

EXAMPLE 2

On one side of the same carbon-containing aramid film as used in Example 1 was provided an isocyanate-containing saturated polyester resin layer (i.e., anchor coat layer, 0.1 μm in thickness). The anchor-coated film was used as the substrate. On the anchor coat layer of the substrate was coated, with a wire bar, a coating material consisting of 3 parts by weight of the cyan dye having the above formula, 4 parts by weight of a moisture curable acryl-silicon resin solution (UA-01, effective ingredient 52% by weight, available from Sanyo Chemical Industries, Ltd.), 0.06 part by weight of di-n-butyltin dilaurate, 0.12 part by weight of a moisture curable fluorine-containing acryl-silicon resin solution (F-2A), 0.4 part by weight of a moisture curable dimethylsiloxane-containing acryl-silicon resin solution (F-6A), 15 parts by weight of toluene and 15 parts by weight of 2-butanone. Then, the resulting sheet was subjected to the same treatment as in Example 1 to obtain a printing sheet including a color material layer having a thickness of about 1 μm.

On the other hand, on a white, anchor-coated PET substrate was coated, with a wire bar, a coating material consisting of 20 parts by weight of an acryl-urethane-silicon resin solution (UA-40), 0.3 part by weight of a reaction accelerator (di-n-butyltin dilaurate), 2 parts by weight of a moisture curable dimethyl-siloxane-containing acryl-silicon resin solution (F-6A) and 20 parts by weight of toluene Then, the resulting sheet was subjected to the same treatment as in Example 1 to obtain an image receiving sheet including a dye-receiving layer having a thickness of about 5 μm.

Then, recording was carried out at a travel speed ratio of the printing sheet to the image receiving sheet of 1:5 and under the following conditions.

Recording speed: 4.2 ms/line

Recording voltage: 32 V

As a result, stable travelling was observed without any trouble between the printing sheet and the image receiving sheet. The recording density was 1.64.

EXAMPLE 3

The same anchor-coated film as in Example 2 was used as the substrate. On the anchor coat layer of the substrate was coated, with a wire bar, a coating material consisting of 3 parts by weight of the cyan dye having the above formula, 3 parts by weight of a moisture curable acryl-urethane-silicon resin solution (UA-53), 0.06 part by weight of di-n-butyltin dilaurate, 0.2 part by weight of a silanol-modified silicone oil (L-9000 (100), available from Nippon Unicar Co., Ltd.), 0.2 part by weight of an alkoxy-modified silicone oil (Y-1587, available from Nippon Unicar Co., Ltd.), 1 part by weight of a styrene-acrylonitrile copolymer resin, 0.25 part by weight of titanium oxide, 20 parts by weight of toluene and 10 parts by weight of 2-butanone. Then, the resulting sheet was subjected to the same treatment as in Example 1 to obtain a printing sheet including a color material layer having a thickness of about 1 μm.

Recording was carried out by using the printing sheet prepared above and the image receiving sheet of Example 2 and under the same conditions as in Example 2. As a result, stable travelling was observed without any trouble between the printing sheet and the image receiving sheet. The recording density was 1.55.

EXAMPLE 4

The same anchor-coated film as in Example 2 was used as the substrate. On the anchor coat layer of the film was coated, with a wire bar, a coating material consisting of 2.5 parts by weight of the cyan dye having the above formula, 4 parts by weight of a polyvinylbutyral resin (BX-1, available from Sekisui Chemical Co., Ltd.), 1.0 part by weight of a moisture curable fluorine-containing acryl-silicon resin solution (F-2A), 0.015 part by weight of di-n-butyltin dilaurate, 30 parts by weight of toluene and 30 parts by weight of 2-butanone. Then, the resulting sheet was treated in the same manner as in Example 1 to obtain a printing sheet including a color material layer having a thickness of about 1 μm. Recording was carried out with the printing sheet prepared above and the image receiving sheet of Example 1 and under the same conditions as in Example 1. As a result, the recording density was 1.8. And no melt-sticking occurred between the printing sheet and the image receiving sheet.

EXAMPLE 5

The same anchor-coated film as used in Example 2 was used as the substrate. On the anchor coat layer of the film was coated, with a wire bar, an ink consisting of 5 parts by weight of the cyan dye having the above formula, 4 parts by weight of a polyvinylbutyral resin (BX-1), 25 parts by weight of toluene and 25 parts by weight of 2-butanone to form a color material layer about 2 μm in thickness on the film. Then, on the color material layer was coated, with a wire bar, a coating material consisting of 3 parts by weight of a polyvinyl butyral resin, 0.5 part by weight of Coronate L (available from Nippon Polyurethane Industry Co., Ltd.), 40 parts by weight of toluene, 40 parts by weight of 2-butanone, and 20 parts by weight of isopropyl alcohol. Then, the resulting sheet was dried and subsequently heat-treated at 50° C. for 12 hours to obtain a sheet including a coating film having a thickness of about 0.3 μm. Then, a coating material consisting of 2 parts by weight of a polyvinyl butyral resin (BX-1), 2 parts by weight of an acryl-urethanesilicon resin solution (UA-53), 0.3 part by weight of a dimethylsiloxane-containing acryl-silicon resin solution whose crosslinking group is methyldimethoxysilyl group (F-6A-4, effective ingredient 53% by weight, available from Sanyo Chemical Industries, Ltd.), 0.04 part by weight of di-n-butyltin diacetate, 0.20 part by weight of dimethyl carbonate, 0.06 part by weight of methanol, 50 parts by weight of toluene and 50 parts by weight of 2-butanone was coated on the coating film with a wire bar. Then, the resulting sheet was heat-treated at 70° C. for 6 hours to obtain a multilayer sheet including a coating film having a thickness of about 0.2 μm. Thus, a multilayer structure printing sheet was prepared.

The printing sheet prepared above was evaluated by using the image receiving sheet prepared in Example 2 and under the same recording conditions as in Example 2. As a result, stable travelling was observed without any trouble between the printing sheet and the image receiving sheet. The recording density was 1.55.

EXAMPLE 6

The same anchor-coated film as in Example 2 was used as the substrate. On the anchor coat layer of the film was coated, with a wire bar, an ink consisting of 5 parts by weight of the cyan dye having the above formula, 4 parts by weight of a polyvinyl butyral resin (BX-1), 25 parts by weight of toluene and 25 parts by weight of 2-butanone to form a color material layer about 2 μm in thickness on the film. Then, on the color material layer was coated, with a wire bar, a coating material consisting of 2 parts by weight of the cyan dye having the above formula, 2 parts by weight of a polyvinyl butyral resin (BX-1), 4 parts by weight of an acryl-urethane-silicon resin solution (UA-53), 0.16 part by weight of a moisture curable dimethylsiloxane-containing acryl-silicon resin solution (F-6A), 0.2 part by weight of an alkoxy-modified silicone oil (Y-1587), 0.08 part by weight of di-n-butyltin diacetate, 0.5 part by weight of dimethyl carbonate, 0.2 part by weight of methanol, 50 parts by weight of toluene and 50 parts by weight of 2-butanone. Then, the resulting sheet was heat-treated at 70° C. for 6 hours to obtain a multilayer sheet including a coating film having a thickness of about 0.2 μm. Thus a multilayer structure printing sheet was prepared.

The printing sheet prepared above was evaluated by using the image receiving sheet prepared in Example 2 and under the same recording conditions as in Example 2. As a result, stable travelling was observed without any trouble between the printing sheet and the image receiving sheet. The recording density was 1.67.

What is claimed is:

1. A dye transfer thermal printing sheet comprising
(a) a substrate, and
(b) a lamina comprising
a dye and
either a cured product of a moisture curable resin or a reaction-cured product of a moisture curable resin and a reactive silicone oil,
on at least one side of the substrate.

2. The sheet of claim 1, wherein the lamina consists of a layer comprising
a dye and
either a cured product of a moisture curable resin or a reaction-cured product of a moisture curable resin and a reactive silicone oil.

3. The sheet of claim 2, wherein the layer contains a thermoplastic resin.

4. The sheet of claim 1, wherein the lamina consists of two layers,
one of which is on at least one side of the substrate and comprises at least one dye and at least one binder, and
the other of which is on the layer comprising at least one dye and at least one binder and comprises either a cured product of a moisture curable resin or a reaction-cured product of a moisture curable resin and a reactive silicone oil.

5. The sheet of claim 4 which further comprises an intermediate layer between the two layers.

6. The sheet of claim 4 wherein the layer comprising at least one dye and at least one binder contains a thermoplastic resin.

7. The sheet of claim 4 wherein the layer comprising at least one dye and at least one binder contains at least one member selected from the group consisting of polyester resin, polyvinyl acetal resin and styrene resin.

8. The sheet of claim 1, wherein the moisture curable resin is at least one member selected from the group consisting of fluorine-containing moisture curable resin, silicone-containing moisture curable resin, moisture curable acryl-silicon resin, moisture curable urethane-silicon resin and moisture curable acryl-urethane-silicon resin.

9. The sheet of claim 8, wherein the moisture curable resin is a fluorine-containing moisture curable resin.

10. The sheet of claim 9, wherein the fluorine-containing moisture curable resin is a moisture curable fluorine-containing acryl-silicon resin.

11. The sheet of claim 8, wherein the moisture curable resin is a silicone-containing moisture curable resin.

12. The sheet of claim 11, wherein the silicone-containing moisture curable resin is a moisture curable silicone-containing acryl-silicon resin.

13. The sheet of claim 1, wherein the moisture curable resin is a combination of at least one member selected from the group consisting of moisture curable acryl-silicon resin, moisture curable urethane-silicon resin and moisture curable acryl-urethane-silicon resin, and at least one member selected from the group consisting of a fluorine-containing moisture curable resin and silicone-containing moisture curable resin.

14. The sheet of claim 1, wherein the moisture curable resin is a silicone-containing acryl-silicon resin having a hydrolyzable silyl group of the formula $$R_1-\underset{|}{Si}-(OR_2)_2,$$

wherein $R_1$ is hydrogen or an alkyl group having 1–4 carbon atoms and $R_2$ is an alkyl group having 1–4 carbon atoms.

15. The sheet of claim 1, wherein the lamina contains at least one member selected from the group consisting of polyester resin, polyvinyl acetal resin and styrene resin.

* * * * *